US007658073B2

(12) United States Patent
Hernandez et al.

(10) Patent No.: US 7,658,073 B2
(45) Date of Patent: Feb. 9, 2010

(54) TURBINE SYSTEMS AND METHODS FOR USING INTERNAL LEAKAGE FLOW FOR COOLING

(75) Inventors: Nestor Hernandez, Schenectady, NY (US); Clement Gazzillo, Schenectady, NY (US); Michael J. Boss, Ballston Spa, NY (US); William Parry, Rexford, NY (US); Karen J. Tyler, Burnt Hills, NY (US)

(73) Assignee: General Electric Company, Schenectady, NY (US)

( * ) Notice: Subject to any disclaimer, the term of this patent is extended or adjusted under 35 U.S.C. 154(b) by 161 days.

(21) Appl. No.: 11/782,169

(22) Filed: Jul. 24, 2007

(65) Prior Publication Data

US 2009/0025389 A1 Jan. 29, 2009

(51) Int. Cl.
*F01K 13/00* (2006.01)

(52) U.S. Cl. ..... 60/677; 60/653; 60/679

(58) Field of Classification Search ..... 60/653, 60/679, 677

See application file for complete search history.

(56) References Cited

U.S. PATENT DOCUMENTS

| | | | | |
|---|---|---|---|---|
| 1,889,307 | A * | 11/1932 | Baumann | 60/680 |
| 3,979,914 | A * | 9/1976 | Weber | 376/402 |
| 4,693,086 | A * | 9/1987 | Hoizumi et al. | 60/663 |
| 5,526,386 | A * | 6/1996 | Tsiklauri et al. | 376/317 |
| 6,443,690 | B1 | 9/2002 | Zabrecky et al. | |
| 7,003,956 | B2 | 2/2006 | Yamashita et al. | |
| 2004/0261417 | A1 | 12/2004 | Yamashita et al. | |

FOREIGN PATENT DOCUMENTS

| | | | |
|---|---|---|---|
| JP | 54153904 | A2 | 12/1979 |
| JP | 56075902 | A2 | 6/1981 |
| JP | 60060207 | A2 | 4/1985 |
| JP | 9032506 | A2 | 2/1997 |

* cited by examiner

*Primary Examiner*—Hoang M Nguyen
(74) *Attorney, Agent, or Firm*—Sutherland Asbill & Brennan LLP

(57) ABSTRACT

A cooling system for a turbine with a first section and a second section. The first section may include a first line for diverting a first flow with a first temperature from the first section, a second line for diverting a second flow with a second temperature less than the first temperature from the first section, and a merged line for directing a merged flow of the first flow and the second flow to the second section.

20 Claims, 2 Drawing Sheets

TURBINE SYSTEMS AND METHODS FOR USING INTERNAL LEAKAGE FLOW FOR COOLING

STATEMENT REGARDING FEDERALLY SPONSORED RESEARCH & DEVELOPMENT

This invention was made with Government support under grant number DE-FC26-07NT43094 awarded by the Department of Energy. The Government has certain rights In the invention.

TECHNICAL FIELD

The present application relates generally to steam turbines and more particularly relates to steam turbines using an internal leakage flow as a reheat cooling flow.

BACKGROUND OF THE INVENTION

Steam turbines often are positioned in a series of varying steam pressures such that a high pressure section, an intermediate pressure section, and a low pressure section may be positioned one after another. Steam generally may be extracted from the steam path of the high pressure section and used downstream as a cooling flow. Because the enthalpy of the steam extracted from the steam path may vary substantially, the exact enthalpy of the extracted steam may be difficult to predict with certainty.

Specifically, an amount of overcooling generally may be necessary to provide, for example, that the wheel space temperatures of the intermediate section are maintained within structural requirements. To ensure such, an amount of overcooling may be needed given the uncertainty of the steam path. The overcooling, however, may cause other structural issues such as shell distortion, vibrations, packing damage, etc. These issues may be due to excessive temperature mismatches between the cooling steam temperature and the wheel space metal temperatures.

There is a leakage flow that extends through the gap between the inner and outer turbine shells. This flow includes the inner end-packing ring flow and the corresponding snout leakage flow. This leakage flow is generally considered a waste of energy in the system. To the extent the leakage flow is used, such leakage is used as a direct cooling flow from a single source, i.e., the temperature of the flow may not be adjusted.

There is a desire, therefore, for improved cooling systems and methods. Preferably such an improved system and method may employ the leakage flow in a productive and efficient manner while improving the efficiency of the overall system.

SUMMARY OF THE INVENTION

The present application thus describes a cooling system for a turbine with a first section and a second section. The first section may include a first line for diverting a first flow with a first temperature from the first section, a second line for diverting a second flow with a second temperature less than the first temperature from the first section, and a merged line for directing a merged flow of the first flow and the second flow to the second section.

The application further describes a method for cooling an intermediate pressure turbine section with a leakage flow from a high pressure turbine section of a turbine. The method includes the steps of directing the leakage flow away from the high pressure turbine section, combining the leakage flow with a reheat flow from the high pressure turbine section to form a combined flow, and directing the combined flow to the intermediate pressure turbine section.

The present application further describes a cooling system for a turbine with a high pressure section and an intermediate pressure section. The cooling system may include a first line for diverting a leakage flow from the high pressure section, a second line for diverting a reheat flow from the high pressure section, and a merged line for directing a merged flow of the leakage flow and the reheat flow to the intermediate pressure section. A throttling valve may be positioned on the second line so as to vary a flow rate of the cold reheat flow.

These and other features of the present application will become apparent to one of ordinary skill in the art when taken in conjunction with the drawings and the appended claims.

DETAILED DESCRIPTION

Figure 1:
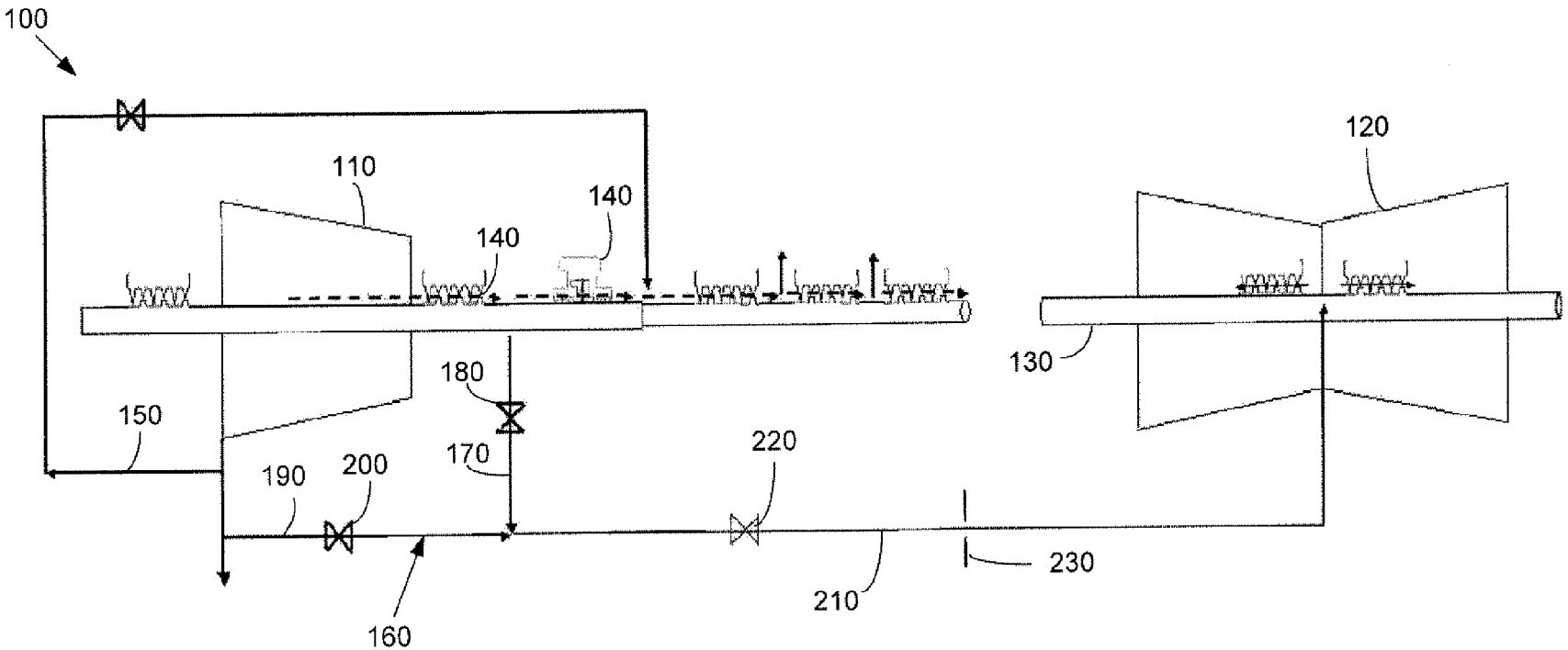
FIG. 1 is a schematic view of a steam turbine with the cooling system as is described herein.

Referring now to the drawings, in which like numerals refer to like elements throughout the several views, FIG. 1 shows a turbine system 100 as is described herein. The turbine system 100 may include a high pressure ("HP" section 110 and an intermediate section ("IP") 120. A low pressure ("LP") section generally also may be used. The HP section 110 and the IP section 120 may be positioned on a shaft 130. The turbine system 100 also includes a number of diaphragm packings 140 for the various stages. The packings 140 may have variable radial clearances and a variable number of packing teeth. A cold reheat line 150 generally may be used from the higher stages of the HP section 110 downstream past the lower stages. Other turbine configurations may be used herein.

The turbine system 100 further may include an IP cooling system 160. The IP cooling system 160 may include a first line 170. The first line 170 may be positioned downstream of the HP section 110 and directs the leakage stream from the leakage between the inner and outer shells, including the inner end-packing ring flow and the corresponding snout leakage flow, away from the HP section 110.

The first line 170 has a first valve 180 positioned thereon. The first valve 180 may be manually operated. The valve opening may be determined by a desired pressure range around the cold reheat pressure. The range may be about two percent (2%) to about five percent (5%). Other ranges may be used herein. The first valve 180 may prevent any exhaust steam from the HP section 110 from flowing backwards between the inner and outer shells and potentially cause a shell distortion. The first valve 180 may be adjusted at unit setup to give a target cooling temperature flow. The valve 180 then may be locked or later adjusted.

The cooling system 160 also includes a second line 190. The second line 190 may be associated with the cold reheat line 150. The second line 190 provides the cooling steam. The second line 190 may include a second valve 200 positioned thereon. The second valve 200 may be a throttling valve. The second valve 200 opens when the cooling steam temperature is higher than, for example, about 925 degrees Fahrenheit (about 496 degrees Celsius). Other temperatures may be used herein. The opening of the second valve 200 may be determined by the target cooling steam temperature. The second valve 200 may provide for a variable flow rate therethrough. The second valve 200 prevents excessive temperatures in the IP section 120.

The first line 170 and the second line 190 may merge into a merged line 210 via a T-joint or other type of connector. The merged line 210 extends into the IP section 120. The merged line 210 may have a merged line valve 220 positioned thereon. The merged line valve 220 may be a hydraulically operated valve that may be fully open or closed. The merged line valve 220 may close to prevent steam from the HP section 110 from leaking into the IP section 120 and contributing to an over-speed condition. The merged line valve 220 may open when the steam turbine load is higher than about five percent (5%) or so and the hot rear temperature is higher than about 1025 degrees Fahrenheit (about 552 degrees Celsius). Other temperatures may be used herein. A flow orifice 230 also may be positioned on the merged line 210. The flow orifice 230 may measure the cooling steam flow rate. An accuracy of about +/− five percent (5%) may be used. Other ranges may be used herein.

In use, internal leakage steam flows through the first line 170 while the cooler steam is provided via the second line 190 from the cold reheat line 150. The second valve 200 generally opens when the cooling steam is of sufficient temperature. The streams merge into the merge line 210 wherein the merged line valve 220 opens based upon the given pressure and temperature. The merged streams are then used in the IP section 120 so as to reduce the temperature of the first reheat stage wheel space and otherwise. The use of the hot steam and the cooler steam thus allows a wide range of cooling temperatures so as to reduce the risk of overcooling while increasing overall turbine reliability.

The cooling system 160 has been tested under a number of operating conditions. These condition include root reaction from zero (0) to about twenty percent (20%), steam turbine loads from about thirty percent (30%) to about full load (100%) (assuming full load temperatures at sliding pressure operation), reheater pressure drops from about five percent (5%) to about eight percent (8%), nozzle to end-packing clearances from about 0.01 to about 0.08 inches (about 0.25 to about two (2) millimeters), and pressure drops from the local extraction to the HP exhaust of about two percent (2%) to about five percent (5%). Heat conduction and cross flow impact were considered. Overall, the wheel space temperature has been maintained under about 925° Fahrenheit (about 496° Celsius) with a cooling steam flow of about 20,000 lbm/hr (about 9,072 kg/hr) for normal clearances and about 30,000 lbm/hr (about 13,608 kg/hr) for double clearances at full load (100%) to between about 5,000 and 10,000 lbm/hr (about 2,268 and 4,536 kg/hr) for normal clearances and between about 10,000 and 15,000 lbm/hr (about 4,536 and 6,804 kg/hr) for double clearances at about a thirty percent (30%) load. Other temperatures and flow rates may be used herein.

The temperature of the cooling steam flow therefore may be adjusted as desired between the hot internal leakage steam and the cold reheat steam. Because the temperature can be controlled, the current requirement for overcooling may be reduced. Likewise, the use of the steam path flow thus may be eliminated. Further, the use of the leakage flow may improve overall system efficiency by about 0.35 percent or so. Further improvements also may be possible.

Figure 2:
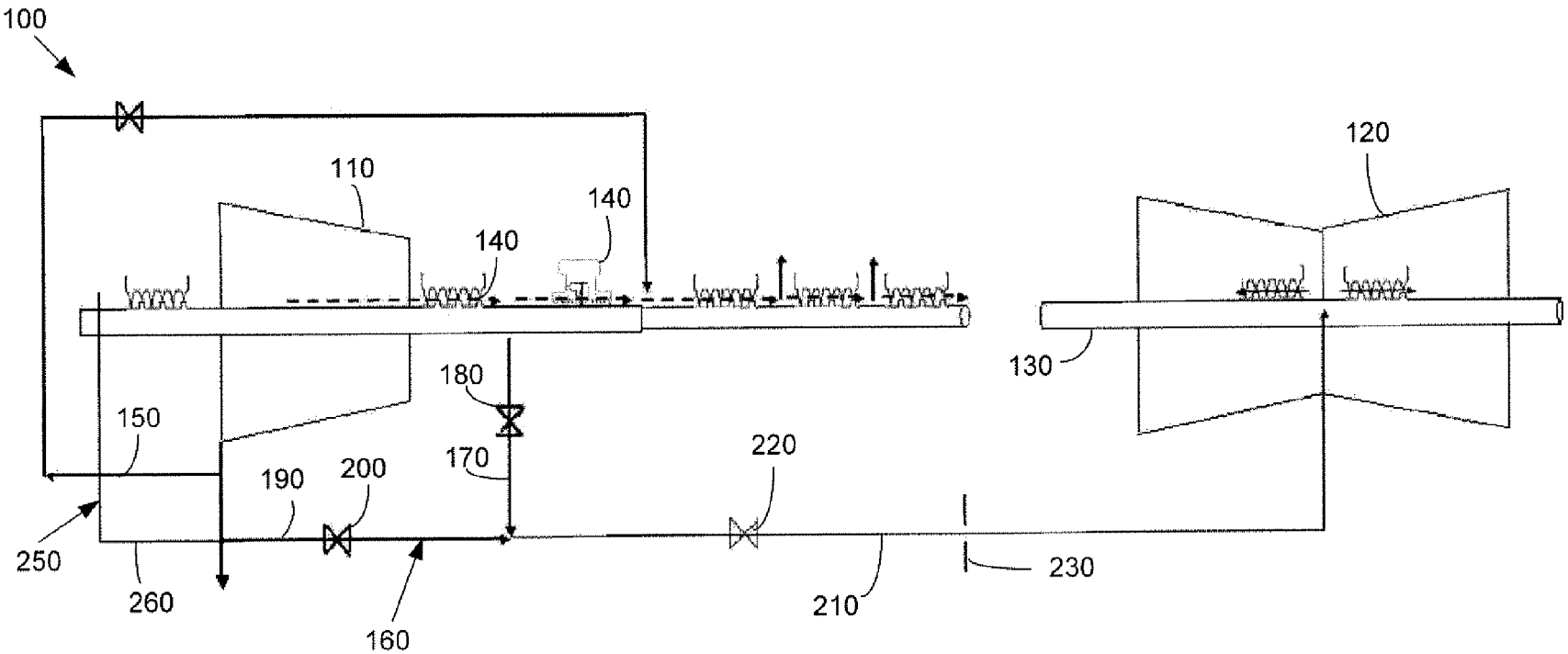
FIG. 2 is a schematic view of a steam turbine with an alternative embodiment of the cooling system as is described herein.

FIG. 2 shows an alternative cooling system 250. Instead of or in addition to the cold reheat line 150, this embodiment may include a high pressure endpacking leakage line 260. The high pressure endpacking leakage line 260 may direct the endpacking leakage steam into the second line 190 and/or the merged line 210. The high pressure endpacking leakage steam also can act as the "cold" source of steam in the system 100 as a whole. Other sources also may be used herein.

It should be apparent that the foregoing relates only to the preferred embodiments of the present application and that numerous changes and modifications may be made herein by one of ordinary skill in the art without departing from the general spirit and scope of the invention as defined by the following claims and the equivalents thereof.

We claim:

1. A cooling system for a turbine with a first section and a second section, comprising:

a first line for diverting a first flow from the first section; wherein the first flow comprises a first temperature;

a second line for diverting a second flow from the first section;

wherein the second flow comprises a second temperature less than the first temperature; and a merged line for directing a merged flow of the first flow and the second flow to the second section;

wherein the merged flow has substantially a same temperature throughout the length of the merged line.

2. The cooling system of claim 1, wherein the first line comprises a first valve thereon to prevent a backflow into the first section.

3. The cooling system of claim 1, wherein the second line comprises a throttling valve thereon.

4. The cooling system of claim 3, wherein the throttling valve begins to open when the second flow exceeds a predetermined temperature.

5. The cooling system of claim 3, wherein the throttling valve comprises a variable flow rate therethrough.

6. The cooling system of claim 1, wherein the merged line comprises a merged line valve.

7. The cooling system of claim 6, wherein the merged line valve opens when the turbine exceeds a predetermined load.

8. The cooling system of claim 6, wherein the merged line valve opens when the second section exceeds a predetermined temperature.

9. The cooling system of claim 6, wherein the merged line valve comprises a hydraulic valve.

10. The cooling system of claim 1, wherein the merged line comprises a flow orifice thereon.

11. The cooling system of claim 1, wherein the first flow comprises a leakage flow.

12. The cooling system of claim 1, wherein the second flow comprises a cold reheat flow.

13. The cooling system of claim 1, wherein the second flow comprises an endpacking leakage flow.

14. A method for cooling an intermediate pressure turbine section with a leakage flow from a high pressure turbine section of a turbine, comprising:

directing the leakage flow away from the high pressure turbine section;

combining the leakage flow with a reheat flow from the high pressure turbine section to form a combined flow; and directing the combined flow to the intermediate pressure turbine section, wherein the combined flow has substantially a same temperature from the high pressure section to the intermediate pressure section.

15. The method of claim 14, wherein the combining step occurs when the reheat flow exceeds a predetermined temperature.

16. The method of claim 14, wherein the directing the combined flow step occurs when the turbine exceeds a predetermined load.

17. The method of claim 14, wherein the directing the combined flow step occurs when the intermediate pressure turbine section exceeds a predetermined temperature.

18. The method of claim 14, further comprising varying a flow rate of the cold reheat flow according to a temperature of the intermediate pressure turbine section.

19. A cooling system for a turbine with a high pressure section and an intermediate pressure section, comprising:

a first line for diverting a leakage flow from the high pressure section;

a second line for diverting a reheat flow from the high pressure section;

a throttling valve positioned on the second line so as to vary a flow rate of the reheat flow; and a merged line for directing a merged flow of the leakage flow and the reheat flow to the intermediate pressure section;

wherein the merged flow has substantially a same temperature throughout the length of the merged line.

20. The cooling system of claim 19, wherein the throttling valve begins to open when reheat flows exceeds a predetermined temperature.

* * * * *